US009192195B2

(12) United States Patent
Dolciato

(10) Patent No.: US 9,192,195 B2
(45) Date of Patent: Nov. 24, 2015

(54) HOLDER FOR SMOKING ARTICLE

(76) Inventor: Rocco Dolciato, Highland Heights, OH (US)

( * ) Notice: Subject to any disclaimer, the term of this patent is extended or adjusted under 35 U.S.C. 154(b) by 77 days.

(21) Appl. No.: 12/886,915

(22) Filed: Sep. 21, 2010

(65) Prior Publication Data

US 2011/0253154 A1 Oct. 20, 2011

Related U.S. Application Data

(60) Provisional application No. 61/244,706, filed on Sep. 22, 2009.

(51) Int. Cl.
*A24F 13/22* (2006.01)

(52) U.S. Cl.
CPC ..... *A24F 13/22* (2013.01)

(58) Field of Classification Search
CPC ..... A24F 13/22
USPC ..... 131/257, 259, 260
See application file for complete search history.

(56) References Cited

U.S. PATENT DOCUMENTS 3,756,252 A * 9/1973 Vigorito ..... 131/256
D311,600 S * 10/1990 Peracca ..... D27/183
5,301,393 A * 4/1994 Brown ..... 24/67.7
6,994,639 B2 * 2/2006 Parks et al. ..... 473/408
D648,891 S * 11/2011 Heger ..... D27/161

OTHER PUBLICATIONS

Definition of "shaft" taken from www.thefreedictionary.com/shaft, on Apr. 5, 2013.*

* cited by examiner

*Primary Examiner* — Richard Crispino
*Assistant Examiner* — Dionne W Mayes
(74) *Attorney, Agent, or Firm* — Curatolo Sidoti Co., LPA; Salvatore A. Sidoti; Daniel E. Moderick, Jr.

(57) ABSTRACT

A holder for a smoking article may be inserted into the ground or golf tee holder on a golf cart, or secured over and about the upper opening leading into a garment pocket or golf bag. The holder is used to protect the smoking article from exposure to poisons and injurious chemicals used in fertilizers, and weed and fungus killers, in addition to water, dirt and debris that also cause damage to a golfer's cigars or cigarettes. A golfer can place a cigar or cigarette between the jaws of the holder, and insert the shaft into the ground or golf tee holder, thereby allowing the golfer to easily insert a tee into the ground, remove a club from the golf bag, take a shot, or drive a cart without holding a cigar or cigarette in his/her hand or mouth, and without having to be concerned about the position or location of a lit cigar or cigarette, and preventing any water, grass, dirt, chemicals or debris from adhering to the smoking article.

12 Claims, 5 Drawing Sheets

HOLDER FOR SMOKING ARTICLE

CROSS REFERENCE TO RELATED APPLICATIONS

This application claims the benefit of the filing date under 35 U.S.C. 119(e) from U.S. Provisional Application For Patent Ser. No. 61/244,706 filed on Sep. 22, 2010, which is hereby incorporated by reference in its entirety.

TECHNICAL FIELD

The disclosure relates to a golf accessory used while playing the recreational game of golf. The golf accessory more particularly relates to a holder for a smoking article, such as a cigar or cigarette, which may by conveniently carried by a golfer for insertion into the ground or attachment to a golf cart so as to provide a convenient support for holding a lighted cigarette or cigar while the golfer is playing a round of golf or practicing at the practice range.

BACKGROUND

Golf has become one of the most popular individual sports engaged in by people of all ages. Given the nature of this outdoor sport, it is common practice for golfers to smoke cigarettes or cigars while playing golf. When a smoking golfer prepares to take a golf swing or stroke, on the tee, in the fairway, in the rough, adjacent to the green, or on the green, the golfer typically lays the lighted cigarette or cigar on the ground.

Typically, the golfer places the cigar on a dry grassy spot in an effort to minimize the exposure of the cigar to the elements. After taking the stroke, the golfer again picks up the lighted cigar and continues to play the game. The practice of laying a lighted cigar on ground is not only unsanitary, but it subjects the golfer to the hazards of contamination from poisons and injurious chemicals used in fertilizers and in weed and fungus killers used to combat the growth of undesirable plants on the golf course. Such impurities can readily be picked up and absorbed by the moistened end of the lighted cigar while laying on the ground. These materials are then transferred to the lips or to the face of the golfer so as to cause infection or other injury.

Hastily laying a cigar or cigarette may also risk exposure of the smoking article to becoming contaminated by water, dirt, or other debris. Thus, in addition to the potential health hazards associated with fertilizers and other chemicals, exposure to water, dirt and debris also cause damage to a golfer's cigars or cigarettes may render them unpalatable.

DETAILED DESCRIPTION

Figure 1:
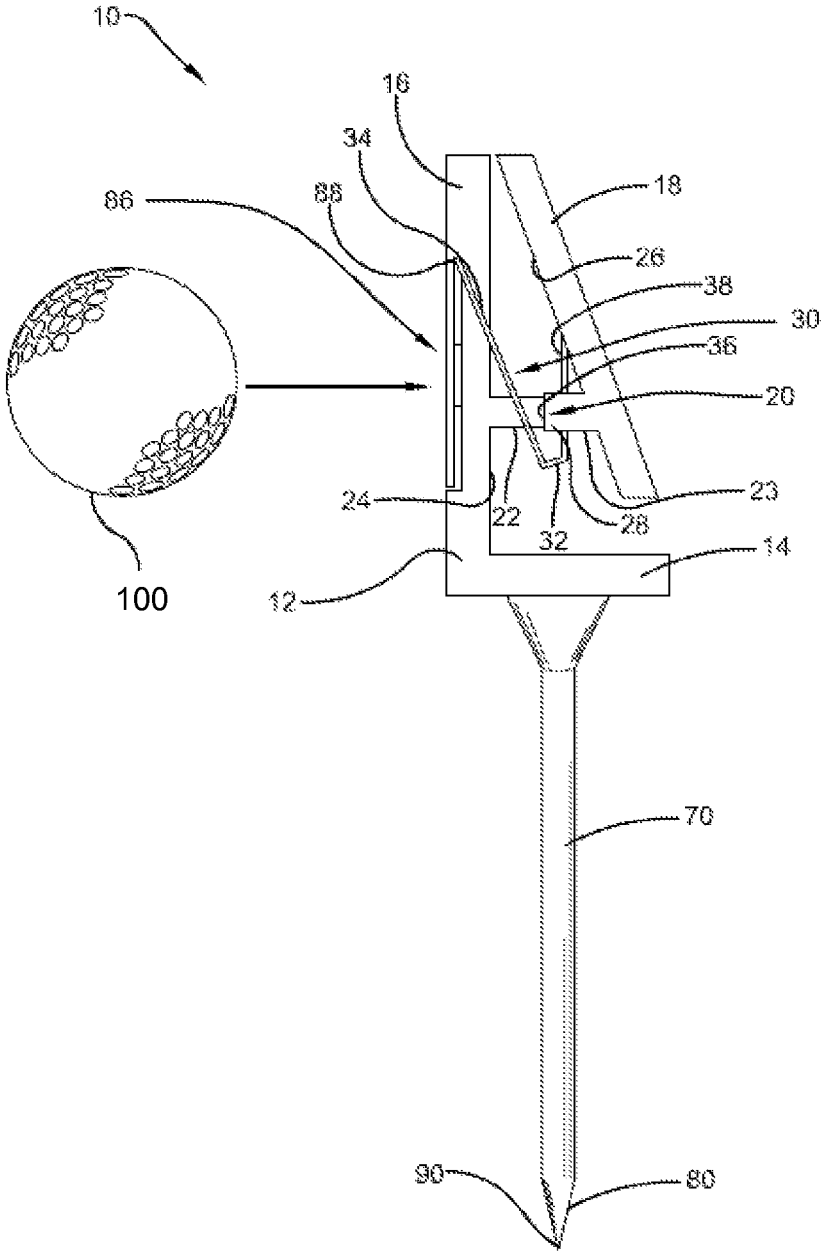
FIG. 1 is a front view of an illustrative embodiment of the smoking article holder.

Disclosed is a holder for holding a smoking article, such as a cigar or cigarette. The holder comprises an elongated shaft portion that is adapted for insertion into the ground. Extending upwardly from the elongated shaft is a stationary arm. A further arm is pivotably connected to the stationary arm. Together, the stationary and pivotable arms define a clamping means for holding a smoking article between the inner facing surfaces of the arms. Because the space between the arms is adjustable, the holder is capable of defining different sized spaces there between for receiving a variety of sizes of smoking articles. The cigar holder permits the user to place cigarettes or cigars into and retrieve cigarettes or cigars from the open end of a cigar holder, while avoiding contact between the smoking article and the ground or grass.

The elongated shaft portion of the holder includes opposite ends and a middle region extending between the opposite ends. According to certain illustrative embodiments, one end of the elongated shaft is tapered and terminates into a point for easy insertion into the ground.

The elongated shaft and stationary arm of the holder may be provided as a single integrally molded piece. Alternatively, the elongated shaft and stationary arm may be separately molded pieces and attached to each other by a suitable attachment means.

The smoking article holder includes a further arm that is pivotably connected to the stationary arm at a pivot point. A biasing member is in contact with the stationary and pivotable arms to control the movement and position of the pivotable arm relative to the stationary arm. Without limitation, the biasing means comprises a spring that is located about the pivot point and having elongated extensions positioned to contact or otherwise engage the arms.

According to certain embodiments, the arms include gripping regions that comprise concave recesses positioned thereon. The concave recesses are formed as an arcuate recess being recessed away from an opposing recess for defining a gripping area therebetween. The pairs of concave arcuate recesses define gripping areas of different dimensions to accommodate different diameters of smoking articles. According to certain embodiments, the inner surfaces of the gripping areas are lined with a non-slip substance means for reducing movement. By way of example, but not in limitation, the non-slip material that is applied to the inner surfaces of the gripping regions comprises a natural rubber, a synthetic rubber, or a rubber that comprises a mixture of both natural and synthetic rubbers.

To hold a cigar or cigarette, the golfer pivots the upper end of the movable arm away from the upper end of the stationary arm by squeezing together the lower ends of the stationary and movable arms. As the golfer continues to apply a greater squeezing force, the lower ends of the stationary and movable arms move closer together and the upper ends of the stationary and movable arms move farther apart. As the upper ends of the arm move farther apart from one another, the golfer is able to easily position a cigar or cigarette between the inner surfaces of the stationary and movable arms. The golfer releases the squeezing force applied to the lower ends of the stationary and movable arms, and upon release such force, the cigar or cigarette is securely held between the arms. The golfer is now able to easily insert a tee into the ground, take a shot, remove a club from the golf bag to make a shot, or drive a cart without holding a cigar or cigarette, without having to be concerned about the position or location of a lit cigar or cigarette, and preventing any grass, dirt or debris from adhering to the cigar or cigarette end.

The holder need not be removed from the ground or golf tee holder in order to gain access to the cigar or cigarette that is secured by the gripping members. The holder need not be inserted into the ground or a golf tee holder for utilization, as the gripping ends of the arms may be affixed to a pocket on a golfer's attire, golf bag or golf cart.

The smoking article holder will now be further described in connection with certain illustrative embodiments depicted in the drawing Figures. It should be noted that the holder should not be limited to the illustrative embodiments depicted by the Figures.

Figures 2, 3:
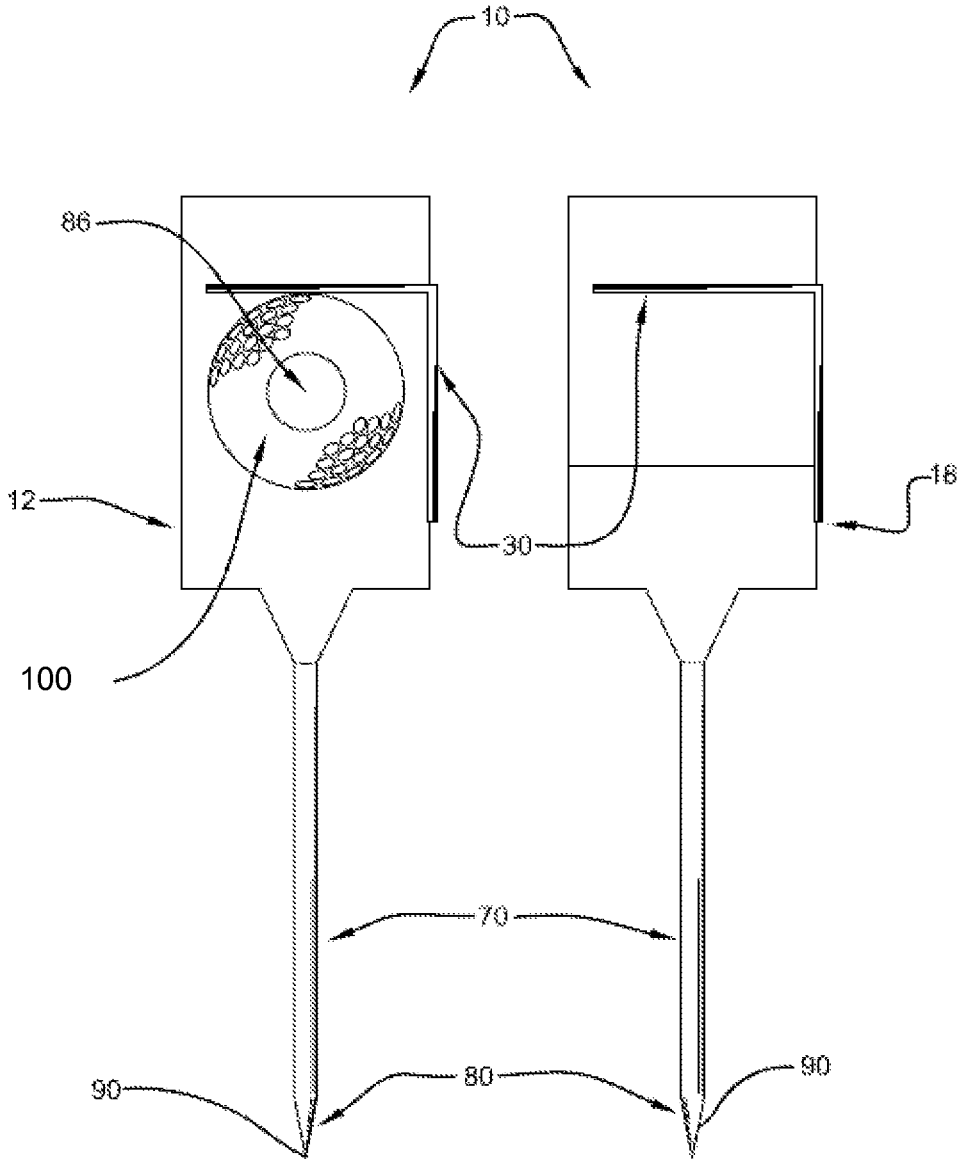
FIG. 2 is a rear view of an illustrative embodiment of the smoking article holder.
FIG. 3 is a side view of an illustrative embodiment of the smoking article holder shown in a closed position.

FIGS. 1-3 show a side view of smoking article holder 10. Smoking article holder 10 includes an elongated shaft 70. The elongated shaft 70 may be of any length, although suitable lengths include those lengths typically used in the art for golf tees. Elongated shaft 70 includes tapered end 80 terminating in a point 90. The lower end 80 of the shaft 70 with a tapered design allows a portion of the elongated shaft 70 to be more easily driven into the ground.

Still referring to FIGS. 1-3, holder 10 includes stationary arm 12 that extends from the upper end of the elongated shaft 70. Stationary arm 12 includes portions 14, 16. Arm 18 is pivotably connected to stationary arm 12 at pivot point 20. Arm 12 includes flange 22 extending from the inner surface 24 of arm 12. Arm 18 includes flange 23 that extends from the inner surface 26 of arm 18. Distal ends of flanges 22, 23 are in mating connection at pivot point 20 located between arms 12, 18. Flanges 22, 23 extending from the inner surfaces of arms 12, 18 include fastener receiving apertures 36. Flanges 22, 23 are secured together at pivot point 20 by a first fastener 28 that is passed through apertures 36. Without limitation, fastener 28 may comprise a bolt, screw, rivet, tack, dowel, pin, or the like.

Still referring to FIGS. 1-3, holder 10 further includes a force applying means comprising a spring 30 that is positioned between the stationary 12 and pivotable arm 18 and is engaged with both arms. Without limitation, spring 30 comprises a central bend portion 32 and angled leg portions 34, 38 projecting away from the central bend portion 32. The spring 30 is shown as an illustrative V-shaped spring. The fastener 22 extends through the apertures 36 to hold the spring 14 in position relative to the arms 12, 18. In the closed position, the leg portions 34, 38 of the spring 30 project generally outwardly from the longitudinal midline of the holder 10. The tension in the spring 30 biases the arms 12, 18 to move closer together.

According to certain illustrative embodiments, holder 10 further includes a logo marker 100 that covers a recess 88 located on the front portion of gripping member 18. The logo marker 100 is attached to the front portion of gripping member 18 by a fastener 86, such as a magnet, screw, rivet, tack, dowel and the like.

Figure 4:
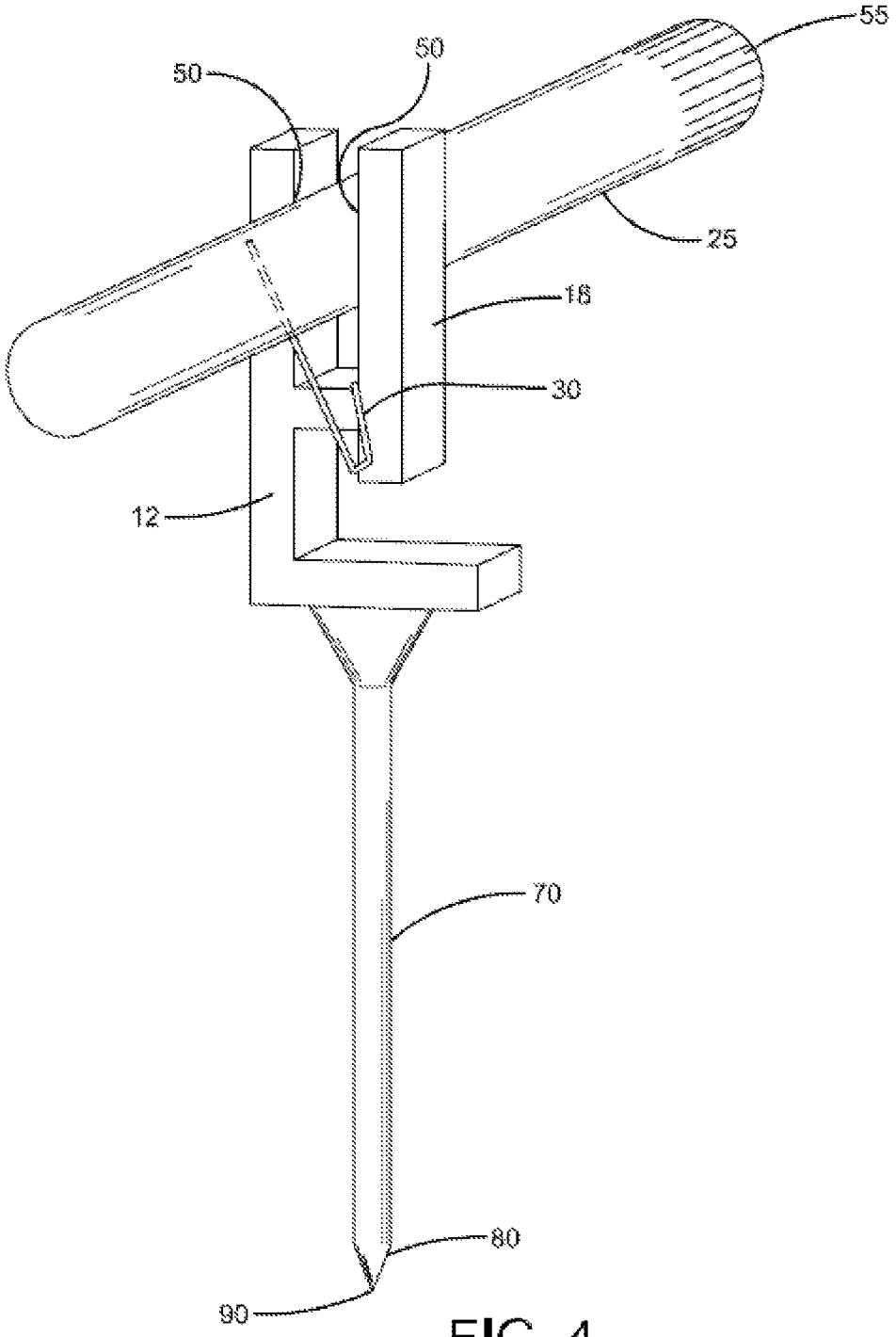
FIG. 4 is a side view of an illustrative embodiment of the smoking article holder in an open position and holding a smoking article.
Figure 5:
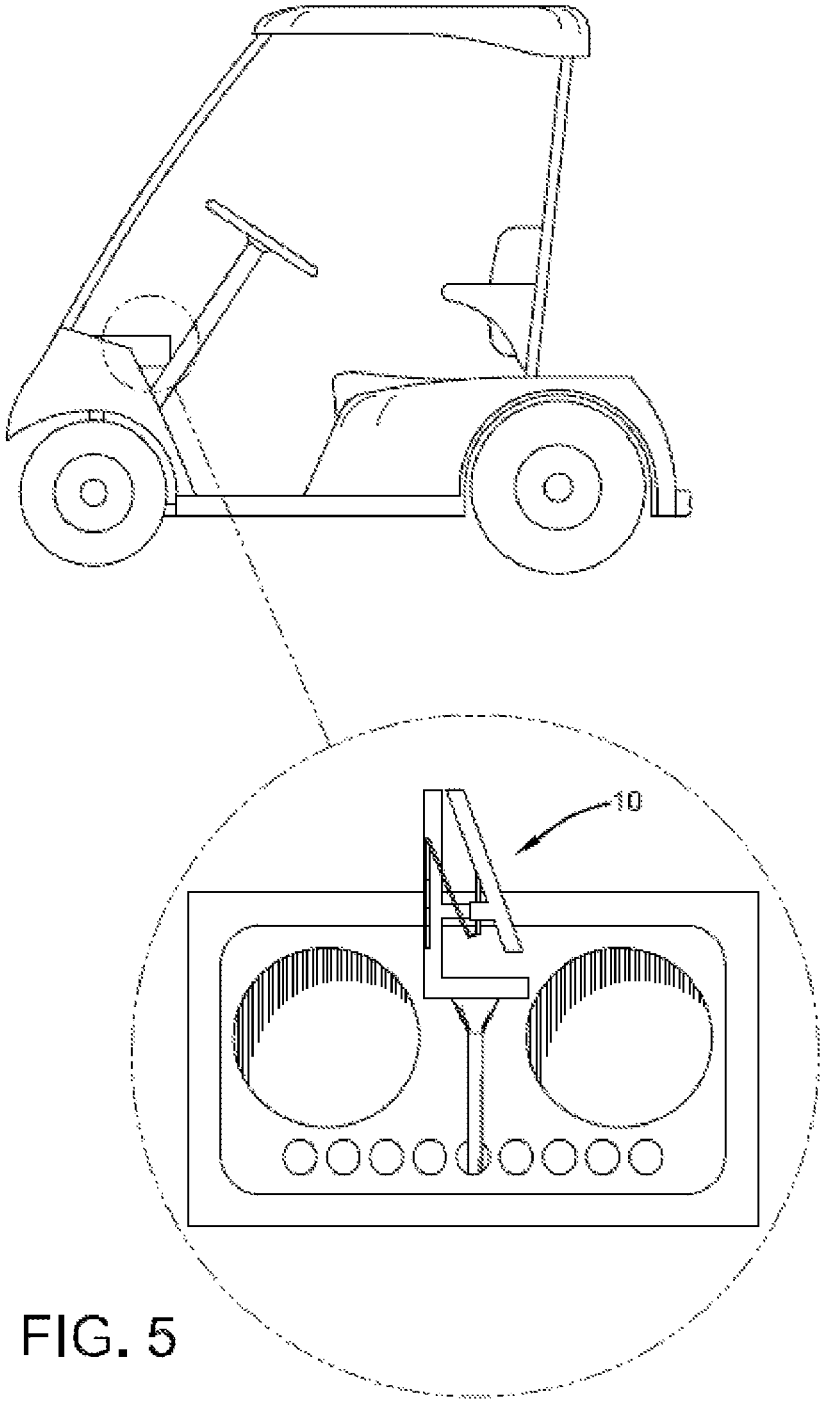
FIG. 5 is a perspective view of an illustrative embodiment of the smoking article holder in a closed position and engaged with a golf cart dashboard golf tee holder.
Figure 7:
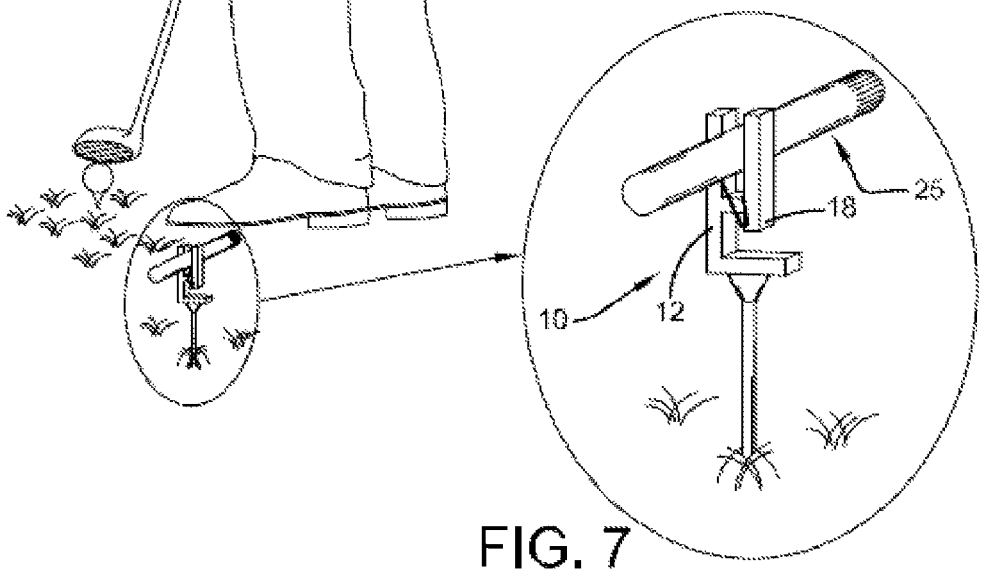
FIG. 7 is a perspective view of an illustrative embodiment of the smoking article holder holding a smoking article and inserted into the ground.

As shown in FIGS. 4 and 7, when it is desired to use the device 10 as a cigar holder, then it is necessary to pivotally and angularly move the movable arm 18 with respect to the stationary arm 12 so as to be in the open configuration. This is accomplished by applying a squeezing force to the lower portion of the movable arm 18 such that the movable arm 18 opens outwardly from the longitudinal midline of the holder 10. This opening will cause the upper ends of the stationary 12 and movable 18 arms to move apart from one another resulting as opposed to their abutting relationship while the device is in closed position as shown in FIGS. 3 and 5. This will allow the holder 10 to be in position for the receipt of a cigar or cigarette 25 therein when a golfer no longer wants to hold his/her lighted cigar or cigarette 25.

Still referring to FIGS. 4 and 7, when the movable arm 18 is fully pressed, the distance between the two arms is sufficient to enable a golfer to place a cigar or cigarette 25 between the spaced-apart arms. The lit end 55 of the cigar or cigarette 25 is placed far enough away from the arms so that unburned portions of the cigar or cigarette 25 will come into contact with the arms when the movable arm 18 is released. The inner surface of the arms 12, 18 comprise a coating or liner 50 of a non-slip substance, such as a rubber material, which allows the smoking article to be better secured within the device 10. This construction ensures that water, chemicals, dirt and debris cannot reach either end of the cigar or cigarette 25. The holder 10 may also include a stop or locking mechanism that is in cooperative contact with the arms and/or spring to prevent the arms from urging toward the closed position when a smoking article is positioned between the two arms so as to avoid squishing the smoking article. The cigar or cigarette 25 is released again by pressing the second movable arm 18 towards the first stationary arm 12, thereby increasing the distance between the gripping members 18 and 20 to sufficiently enable a golfer to remove the cigar or cigarette 25 from the device 10.

According to further illustrative embodiments, the inner surfaces of the arms 12, 18 further include concavely shaped depressions or recessions to further accommodate the outer geometry of various sized smoking articles.

FIG. 5 shows a typical golf cart used by golfers to traverse a golf course while playing a round of golf. The front dash portion of the golf cart typically includes a molded plastic area for holding golf accessories, such as golf balls, golf tees, golf gloves, and food and beverages. An illustrative embodiment molded dash portion of the golf cart is shown in perspective. The dash portion included two spaced apart recesses for holding beverage cups. The dash includes a plurality of openings extending into the dash for holding elongated golf tees. Smoking article holder 1 is shown engaged with the golf tee openings in the dash of the golf cart by inserting the elongated shaft portion of the holder into the opening where a golf tee would be traditionally held.

Figure 6:
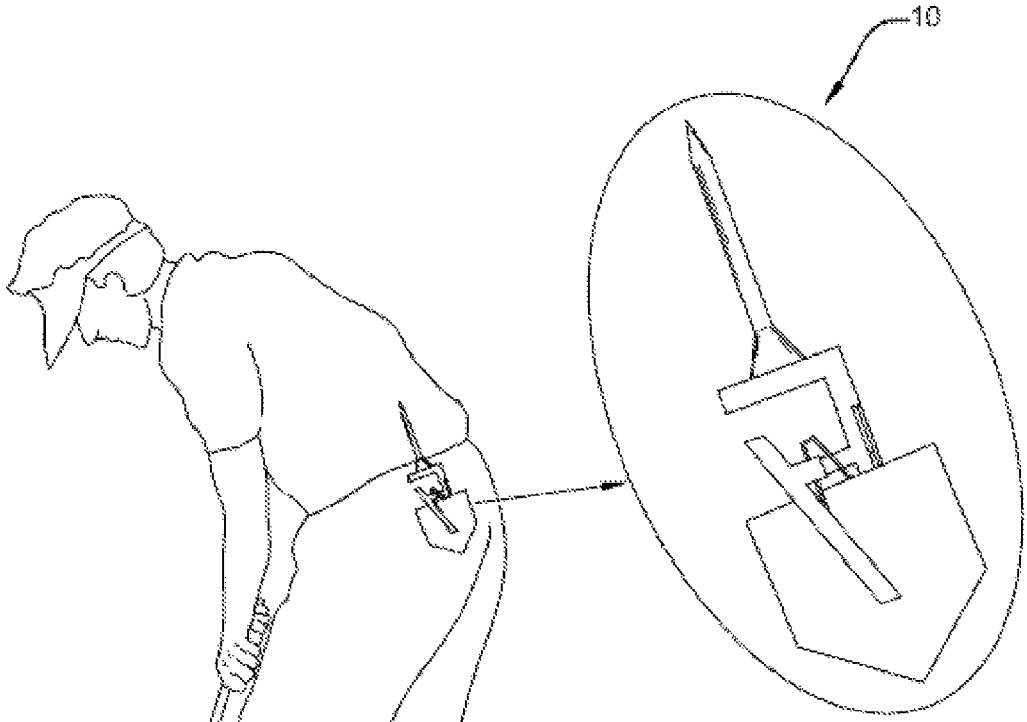
FIG. 6 is a perspective view of an illustrative embodiment of the smoking article holder and showing the engagement of the holder with a rear pocket on a golfer's pants.

FIG. 6 shows a golfer addressing a golf ball on a golf tee prior to taking a stroke. The golfer is wearing a pair of long pants having rear pockets. The rear pocket of the pants of the golfer is shown in an enlarged fragmentary view. The smoking article holder 10 is inserted into the rear pocket of the wearable pants and the inner gripping surfaces of the stationary and pivotable arms are closed with the fabric of the pocket gripped there between. The force applied by the spring against the arms maintains gripping connection with the fabric of the pocket.

FIG. 7 shows the smoking article holder 10 inserted into the ground. The tapered end 80 of the elongated shaft 70 of the holder 10 is partially inserted into the ground. The holder 10 is shown holding a cigar 25 between the gripping surfaces of the arms of the holder 10. Thus, the cigar 25 is elevated and does not come into direct contact with the ground or grass.

While the cigar holder has been described in connection with various illustrative embodiments, as shown in the Figures, it is to be understood that other similar embodiments may be used or modifications and additions may be made to the described embodiments for performing the same functions. Therefore, the cigar holder device should not be limited to any single embodiment, but rather construed in breadth and scope in accordance with the recitation of the appended claims.

I claim:

1. A holder for a smoking article comprising:

a single elongated shaft having a longitudinal axis and oppositely-positioned top and bottom ends, wherein said bottom end is tapered and terminates in a point;

a stationary arm extending from said top end of said elongated shaft, wherein said stationary arm comprises a first support portion extending outwardly and substantially perpendicularly to the axis of said elongated shaft, and a second portion extending outwardly from said first support portion and substantially parallel to the axis of said elongated shaft, wherein said elongated shaft and said stationary arm are a single integrally molded piece;

a moveable arm pivotably attached to said stationary arm;

a flange extending from inner surface of said second portion of said stationary arm, and a flange extending from an inner surface of said moveable arm, wherein said flanges are in mating connection at a pivot point located between said arms; and a biasing member engaged with said stationary and said moveable arms.

2. The holder of claim 1, wherein at least one of said stationary and second arms further comprises gripping regions.

3. The holder of claim 1, wherein inner surfaces of said stationary and second arms further comprise concave recesses.

4. The holder of claim 1, wherein the inner surfaces of the stationary and second arm are lined with a slip resistant material.

5. The holder of claim 4, wherein the slip resistant material comprises a rubber.

6. The holder of claim 1, wherein said biasing member comprises a spring.

7. The holder of claim 6, wherein said spring is located about a pivot point and having extensions positioned to engage said arms.

8. The holder of claim 7, wherein the spring comprises a substantially V shape.

9. The holder of claim 6, wherein said spring has portions engaged with the outer surfaces of the stationary and second arms and a portion extending between said arms.

10. The holder of claim 9, wherein said portion of said spring extending between said arms extends below said flanges.

11. The holder of claim 1, further comprising a stop mechanism in cooperative contact with at least one of said stationary arm, said second arm and said biasing member.

12. The holder of claim 1, further comprising a logo marker attached to said stationary arm.

* * * * *